US008366414B2

(12) United States Patent
Kaufmann et al.

(10) Patent No.: US 8,366,414 B2
(45) Date of Patent: Feb. 5, 2013

(54) DIAPHRAGM PUMP

(75) Inventors: Stephan Kaufmann, Gunzwil (CH); Christian Kissling, Fulenbach (CH)

(73) Assignee: KNF Flodos AG, Sursee (CH)

( * ) Notice: Subject to any disclaimer, the term of this patent is extended or adjusted under 35 U.S.C. 154(b) by 312 days.

(21) Appl. No.: 12/666,521

(22) PCT Filed: Mar. 14, 2008

(86) PCT No.: PCT/EP2008/002043

§ 371 (c)(1),
(2), (4) Date: Dec. 23, 2009

(87) PCT Pub. No.: WO2009/003540

PCT Pub. Date: Jan. 8, 2009

(65) Prior Publication Data

US 2010/0196176 A1 Aug. 5, 2010

(30) Foreign Application Priority Data

Jun. 29, 2007 (DE) ..... 10 2007 030 311

(51) Int. Cl.
*F04B 45/00* (2006.01)

(52) U.S. Cl. ..... 417/412; 417/413.1; 310/15; 92/134; 92/143; 92/85 B; 335/61; 335/240; 335/257; 335/271; 335/277; 335/258

(58) Field of Classification Search ..... 417/412, 417/413.1; 310/14, 15, 16, 17, 19, 20, 21, 310/22, 23, 24; 92/134, 85 B, 143, 84; 335/61, 335/240, 257, 271, 277; 267/64.11, 64.15, 267/64.22

See application file for complete search history.

(56) References Cited

U.S. PATENT DOCUMENTS

| | | | | |
|---|---|---|---|---|
| 4,143,998 | A * | 3/1979 | O'Connor | 417/413.1 |
| 4,607,627 | A | 8/1986 | Leber et al. | |
| 4,832,582 | A * | 5/1989 | Buffet | 417/413.1 |
| 5,284,425 | A * | 2/1994 | Holtermann et al. | 417/395 |
| 5,467,961 | A * | 11/1995 | Sausner et al. | 251/129.15 |
| 6,568,926 | B1 | 5/2003 | Mount | |
| 6,758,657 | B1 | 7/2004 | McNaull et al. | |
| 2006/0261527 | A1 * | 11/2006 | Lange et al. | 267/120 |
| 2007/0236089 | A1 * | 10/2007 | Okubo | 310/30 |

FOREIGN PATENT DOCUMENTS

EP 0286404 10/1988

* cited by examiner

*Primary Examiner* — Devon Kramer
*Assistant Examiner* — Joseph Herrmann
(74) *Attorney, Agent, or Firm* — Volpe and Koenig, P.C.

(57) ABSTRACT

A diaphragm pump (1) having a diaphragm (11), a solenoid with a movable magnetic armature (8) as a drive element for the diaphragm (11), and a stop element (9) for adjusting the stroke for the drive element (8). The diaphragm pump includes at least one elastic damper (36) between the drive element (8) and the stop element (9), which elastic damper (36) has at least one compression chamber (26) which is surrounded and formed by at least one elastic boundary wall and by at least one rigid boundary wall of the drive element (8) and/or stop element (9).

9 Claims, 9 Drawing Sheets

DIAPHRAGM PUMP

BACKGROUND

The invention relates to a diaphragm pump comprising a diaphragm, a solenoid with a movable magnetic armature as the drive element for the diaphragms, and a stop element for adjusting the stroke of the drive element, with at least one elastic damper being provided between the drive element and the stop element.

Diaphragm pumps of this type are known from prior art, for example from the U.S. Pat. No. 6,568,926 B1 or U.S. Pat. No. 4,143,998, and are widely used. Additionally, FR 2 485 108 A and U.S. Pat. No. 6,758,657 B1 also disclose such diaphragm pumps. Depending on their design, the noise developed by such pumps is rather high.

SUMMARY

The object of the invention is to provide a diaphragm pump of the type mentioned at the outset, with its operating noise being considerably reduced.

This object is attained according to the invention in the elastic damper comprising at least one compression chamber, which is enclosed and formed by at least one elastic limiting wall and by at least one stiff wall of the drive element and/or the stop element.

In a preferred embodiment of the invention the elastic limiting wall is formed by a ring made from an elastic material.

The elastic ring acts as a first damper in the downward motion of the drive element. A compression chamber is formed inside the ring by the ring contacting the opposite limiting wall, ensuring an additional slowing of the motion of the drive elements. The compression of the air in the compression chamber causes a progressive dampening characteristic such that the dampening increases with the distance becoming shorter. By the time the drive element contacts the stop element it has slowed to such an extent that only low noise develops. The damper with the compression chamber therefore acts as a pneumatic spring. By the air cushion in the compression chamber braking the motion, the elastic ring is relieved and thus its life is extended.

For operation, the elastic damper is dimensioned such that during each stroke executed by the drive element the drive element contacts the stop element. This results in the drive element performing a defined stroke and the pump conveys a precisely defined volume, which remains constant even in case of the damper failing.

It is particularly beneficial for the elastic ring to be inserted into a groove or onto a shoulder of the drive element and/or stop element. This way the assembly of the ring is facilitated and it is prevented that the ring slips or becomes damaged during operation. Here, the ring projects beyond the respective limiting wall, allowing it to influence the dampening by its projection.

In another advantageous embodiment of the invention at least one recess is arranged inside the elastic ring in at least one stiff limiting wall of the drive element and/or the stop element, increasing the air volume of the compression chamber and thus also influencing the dampening characteristic. Another advantage of this arrangement is the fact that the recess is effectively enlarged on a small area of the compression volume such that the operating gap between the drive element and the stop element can be selected narrower without having to waive any additional dampening. Due to the short distance, the resistance for the magnetic flux, formed by the operating gap between the drive element and the stop element, is reduced and the pump can therefore build up a greater pressure with a reduced stroke.

Another embodiment of the invention with an improved magnetic flux provides that the stiff limiting wall ends flush with or projects from the elastic ring inserted into the groove or placed upon the shoulder and that a ring is provided on the opposite stiff limiting wall, impinging the circumferential circular flange in the stop position.

In all embodiments, the elastic ring is not limited to a circular shape. Rather arbitrary, closed shapes are possible, conditional to allowing a volume to be formed inside by covering the planar sides.

Advantageous further embodiments are discernible from the drawings as well as the dependent claims and by combining several features.

BRIEF DESCRIPTION OF THE DRAWINGS

In the following, preferred embodiments of the diaphragm pump according to the invention are explained in greater detail using the drawings. They show.

DETAILED DESCRIPTION OF THE PREFERRED EMBODIMENTS

Figure 1:
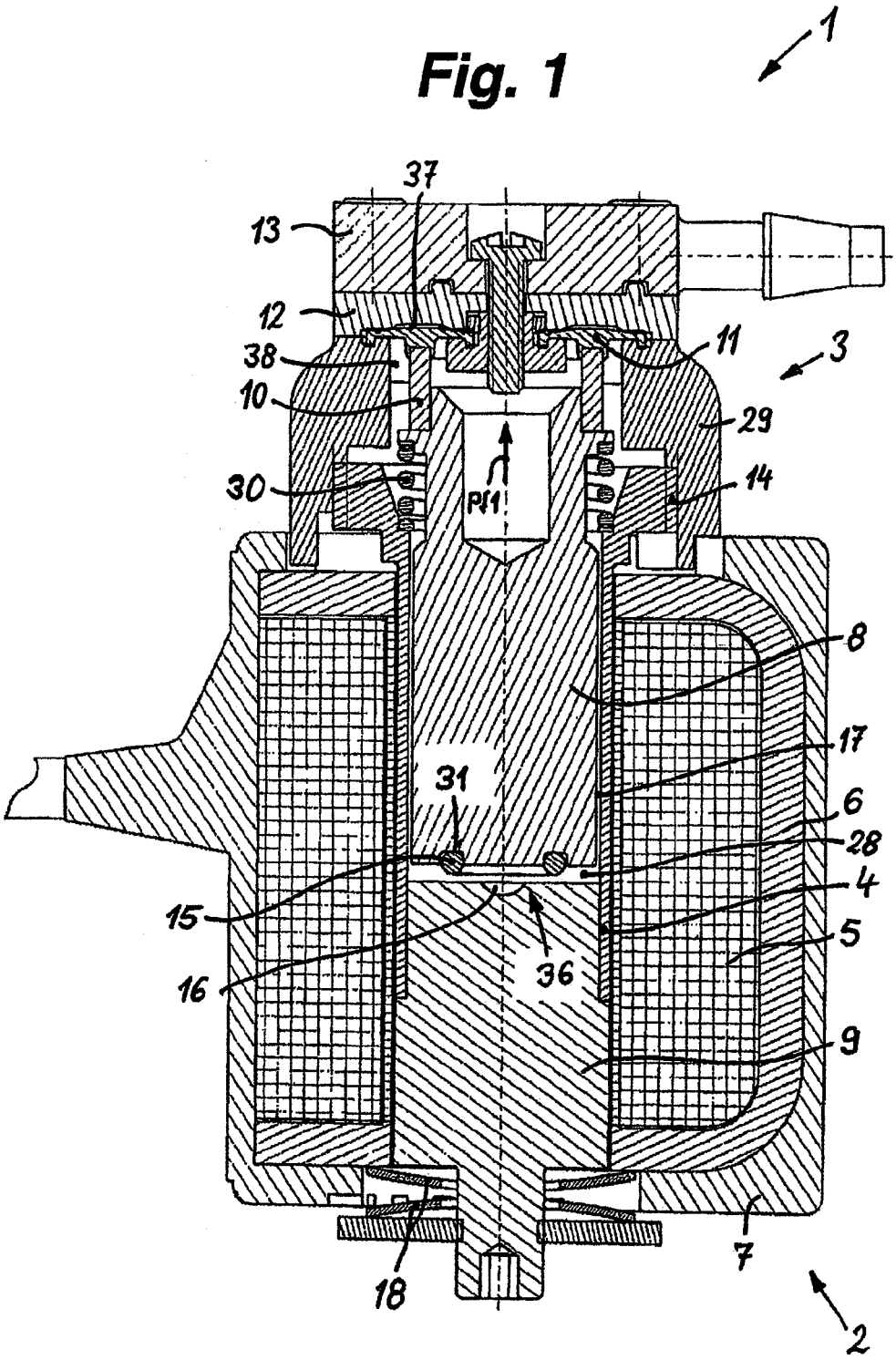
FIG. 1 is a cross-sectional view of a diaphragm pump according to the invention.

FIG. 1 shows a diaphragm pump marked 1 in its entirety. The pump 1 essentially comprises a drive part 2 and a pump part 3.

The drive part 2 has a solenoid with a magnetic coil 5, which is surrounded by a yoke 6, held in the drive housing 7 and forming the stator of the drive.

Inside the magnetic coil 5, an armature 8 can be moved back and forth as a drive element, connected via a drive sheath 10 to the diaphragm 11. The armature 8 is impinged by a compression spring 30 in the direction of the operating stroke (arrow Pf 1) such that the armature 8 with the diaphragm 11 is moved towards the diaphragm chamber 37. When the magnetic coil 5 is subjected to a current feed, the armature 8 is moved inversely in the direction of the intake stroke, opposite the arrow direction Pf 1.

The face of the armature 8 facing away from the diaphragm 11 faces a stop element 9 comprising a ferromagnetic material, connected to a sheath 4 in a torque-proof fashion. The sheath 4 projects beyond the stop element 9, with the armature 8 being guided inside the sheath 4. At the end facing the pump head the sheath 4 is screw connected via a thread 14 to the pump housing 29. The compression spring 30 is supported on a shoulder of the sheath 4.

The axial position of the stop element 9 can be changed by rotating the stop element 9 in the thread 14 and thus the operating gap 28 between the armature 8 and the stop element 9. Compare FIGS. 1B and 1C. The operating gap 28 is equivalent to the maximum stroke of the armature 8 and thus determines the volume conveyed per stroke.

At its exterior end section, the stop element 9 is subjected to tensile stress towards the outside by a disk spring 18.

A circular gap 17 is formed between the sheath 4 and the armature 8 such that the armature is guided smooth-running in the sheath 4.

Additionally, the circular gap 17 forms a ventilation channel, via which the air can exit, which is displaced from the operating gap 28 by the armature 8 when approaching the stop element 9.

Figure 1A:
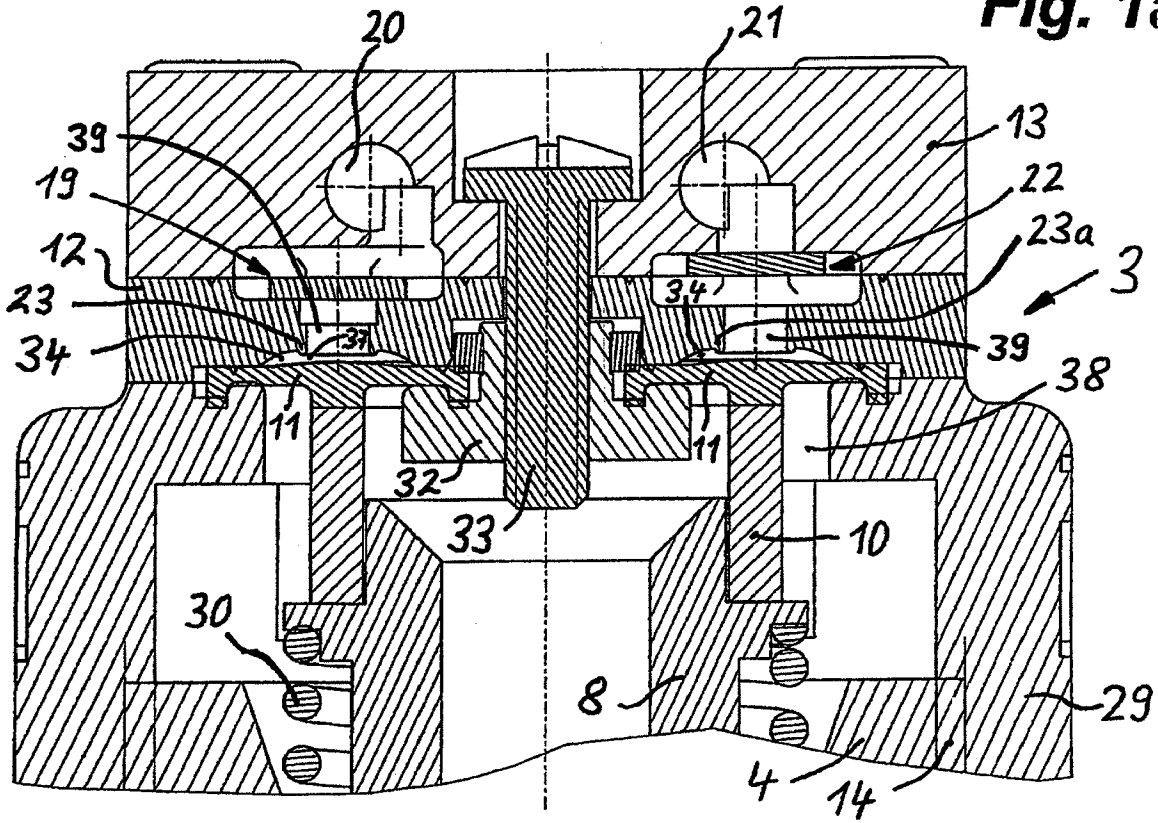
FIG. 1*a* is a detailed view of a part of the diaphragm pump according to the invention.
Figure 1C:
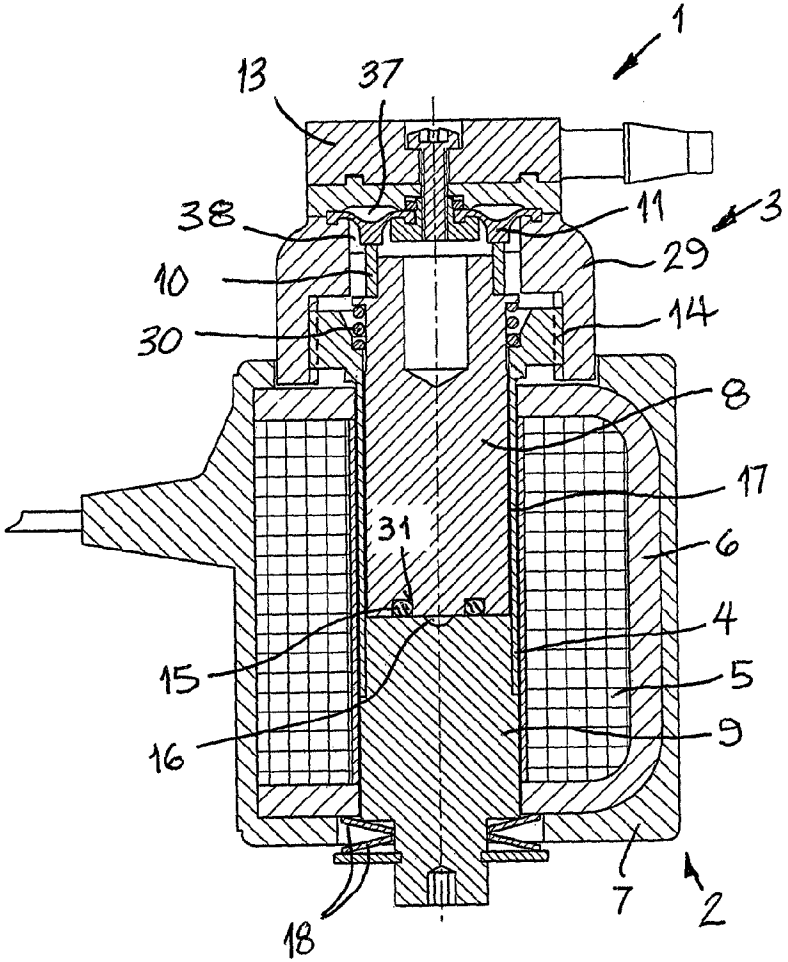
FIG. 1C is a view of the diaphragm pump of FIGS. 1 and 1B shown with the axial position of the stop element adjusted from the position shown in FIG. 1B to adjust the maximum stroke.
Figure 1B:
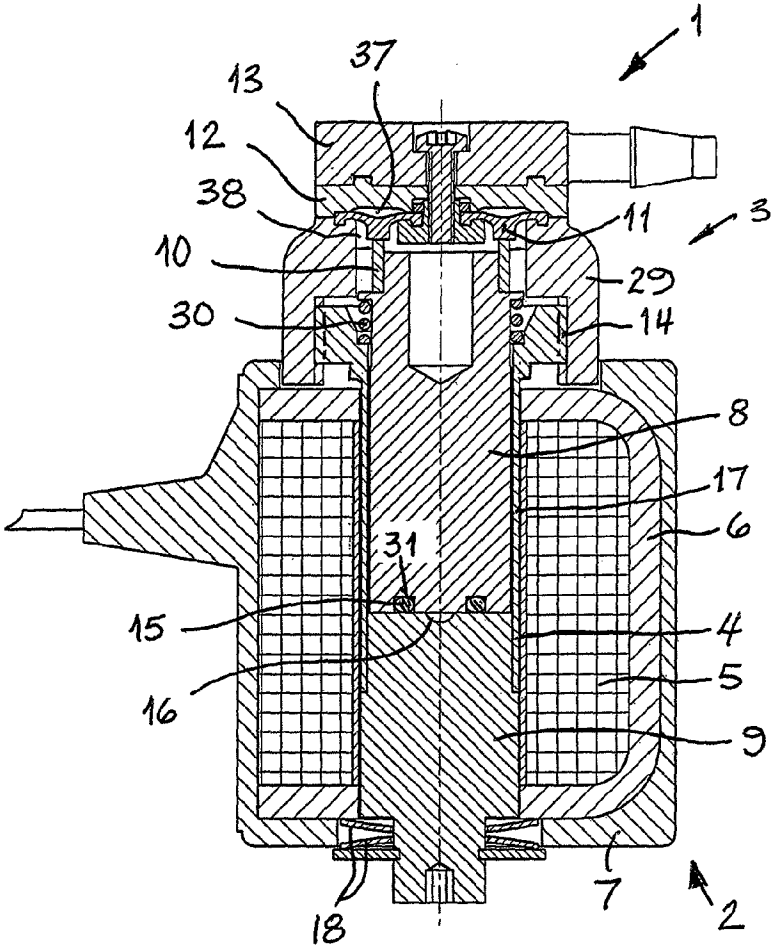
FIG. 1B is a view of the diaphragm pump of FIG. 1 with the armature in a bottom position contacting the stop element.

In FIG. 1*a* the pump part 3 of the diaphragm pump 1 is shown enlarged for a better illustration. At its exterior perimeter the circular diaphragm 11 contacts the edge of the pump housing 29 and is here clamped by the diaphragm cover 12. At the interior perimeter of the diaphragm 11, a suspension member 32 is engaged, which is pulled by the tensile screw 33 towards the diaphragm cover 12 and thus clamps the diaphragm 11.

Together with the diaphragm cover 12, the diaphragm 11 limits the diaphragm chamber 37 and thus the actual operating volume. The inlet valve 22 and the outlet valves 19 are located in the diaphragm cover 12 and the pump lid 13 positioned thereupon and are each connected to the diaphragm chamber 37 and on the other side to the inlet connectors 21 and the outlet connectors 20 of the pump.

During operation, the armature 8 with the diaphragm 11 performs an upward and downward motion, which is limited on the one side by the diaphragm cover 12 and on the other side by the stop element 9.

Figure 2A:
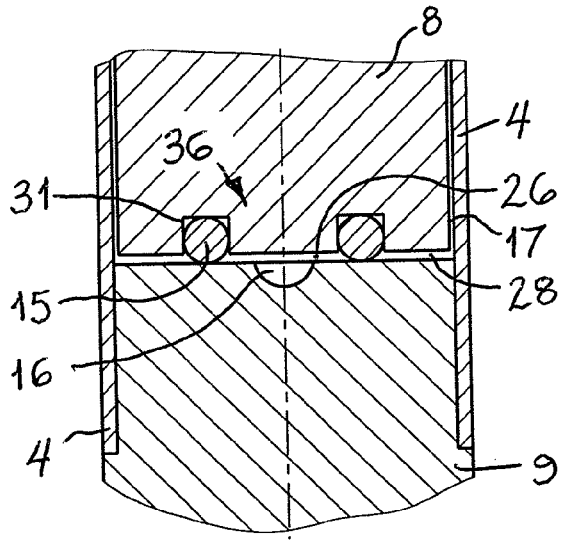
FIGS. 2A and 2B are enlarged views of a diaphragm pump in the region of the elastic damper.

According to the invention, in the bottom dead center area an elastic damper 36 is provided between the armature 8 and the stop element 9, comprising an elastic ring 15 inserted into a circular groove 31 of the lower wall face of the armature 8, shown in detail in FIG. 2A, which forms a limiting wall.

Figure 2B:
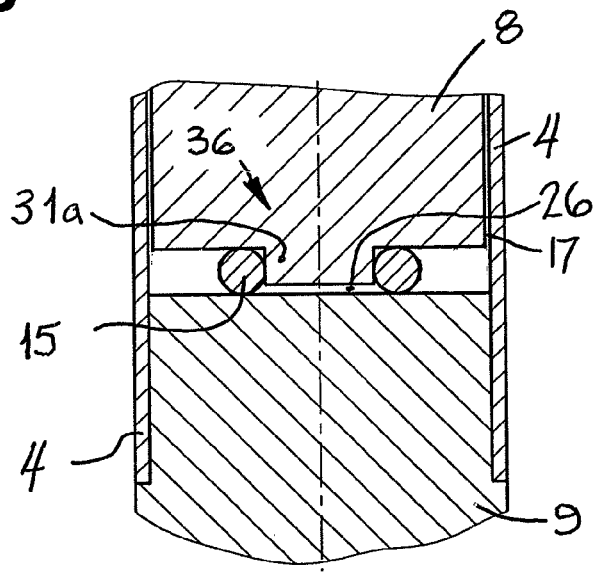

The elastic ring 15 can also be placed upon a shoulder 31*a*, as indicated in FIG. 2B. When feeding a current to the magnetic coil 5, the downward motion of the armature 8 is dampened when the elastic ring 15 contacts the limiting wall of the stop element 9. As discernible from FIG. 2, when the ring 15 contacts the face of the stop element 9 in the interior space of the ring between the limiting walls of the armature 8 and the stop element 9, a compression chamber 26 forms enclosing an air volume.

A dampening effect by compressing the air is achieved in addition to the elastic deformation of the ring 15, which is the greater the further the two limiting walls approach each other. The compression volume can be enlarged by an additional recess 16 (FIG. 2A) and adjusted to the respective application.

The remaining exterior operating gap 28 is ventilated via the circular gap 17 and thus has no influence on the dampening. This ensures a defined dampening, largely independent from the environmental conditions.

In the upper dead center position, the motion of the armature 8 is slowed and dampened by the elastic diaphragm 11. In the pump area another dampening can be provided according to the principle of the compression chamber, as discernible in FIG. 1*a*. For this purpose, circumferential sealing rims 23, 23*a* are arranged at the mouth openings of the valve connection channels 39 in the diaphragm cover 12, extending into the diaphragm chamber 37. When the diaphragm 11 contacts the sealing edges 23, 23*a* the diaphragm chamber 37, then sealed towards the outside, forms a compression chamber 37 and dampens the stroking motion near the upper dead center.

Figure 3:
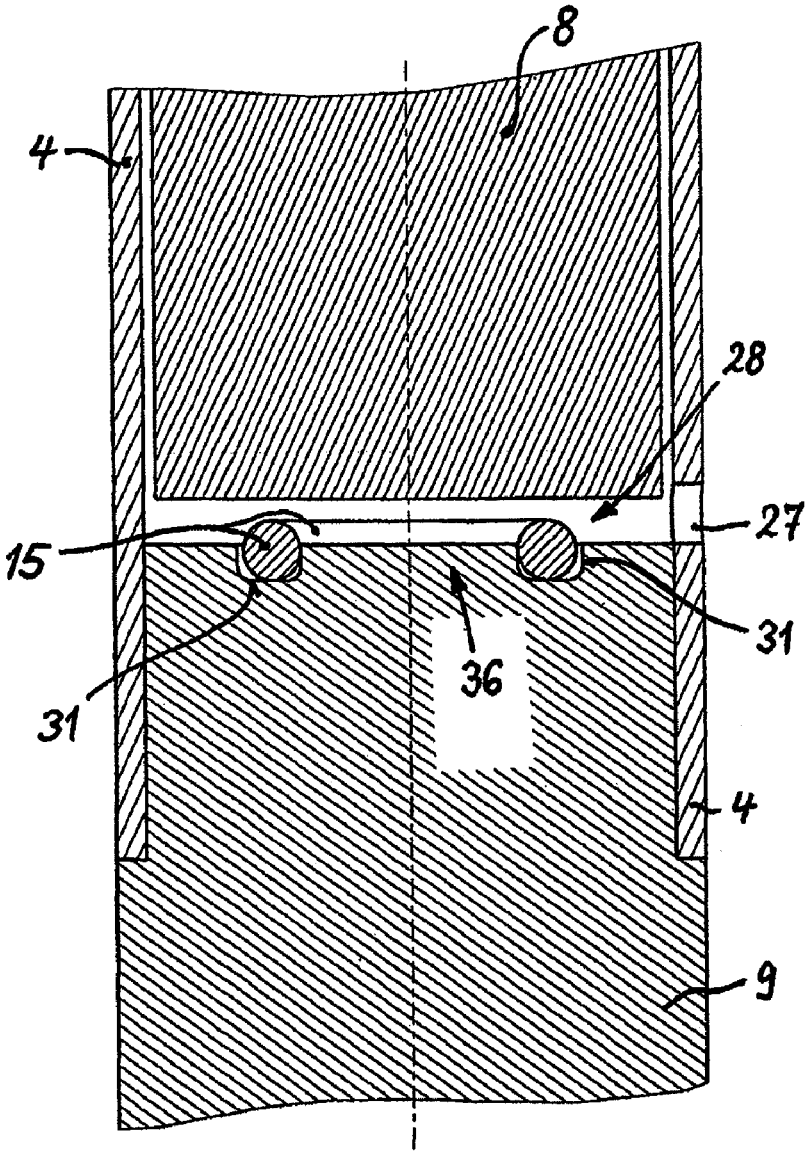
FIGS. 3-7 are views of additional embodiments of elastic dampers.

FIG. 3 shows another embodiment of the elastic damper 36. Deviating from the embodiment shown in FIG. 2, the elastic ring 15 is inserted into a groove 31 in the limiting facial wall of the stop element 9. This way, the ring 15 is not subject to any acceleration forces during operation and therefore the position in the groove 31 is secured.

In this exemplary embodiment, in order to ventilate the operating gap 28 a lateral opening 27 is provided in the sheath 4 such that the air displaced by the armature 8 can exit faster and has no slowing effect upon the motion of the armature.

Figure 4:
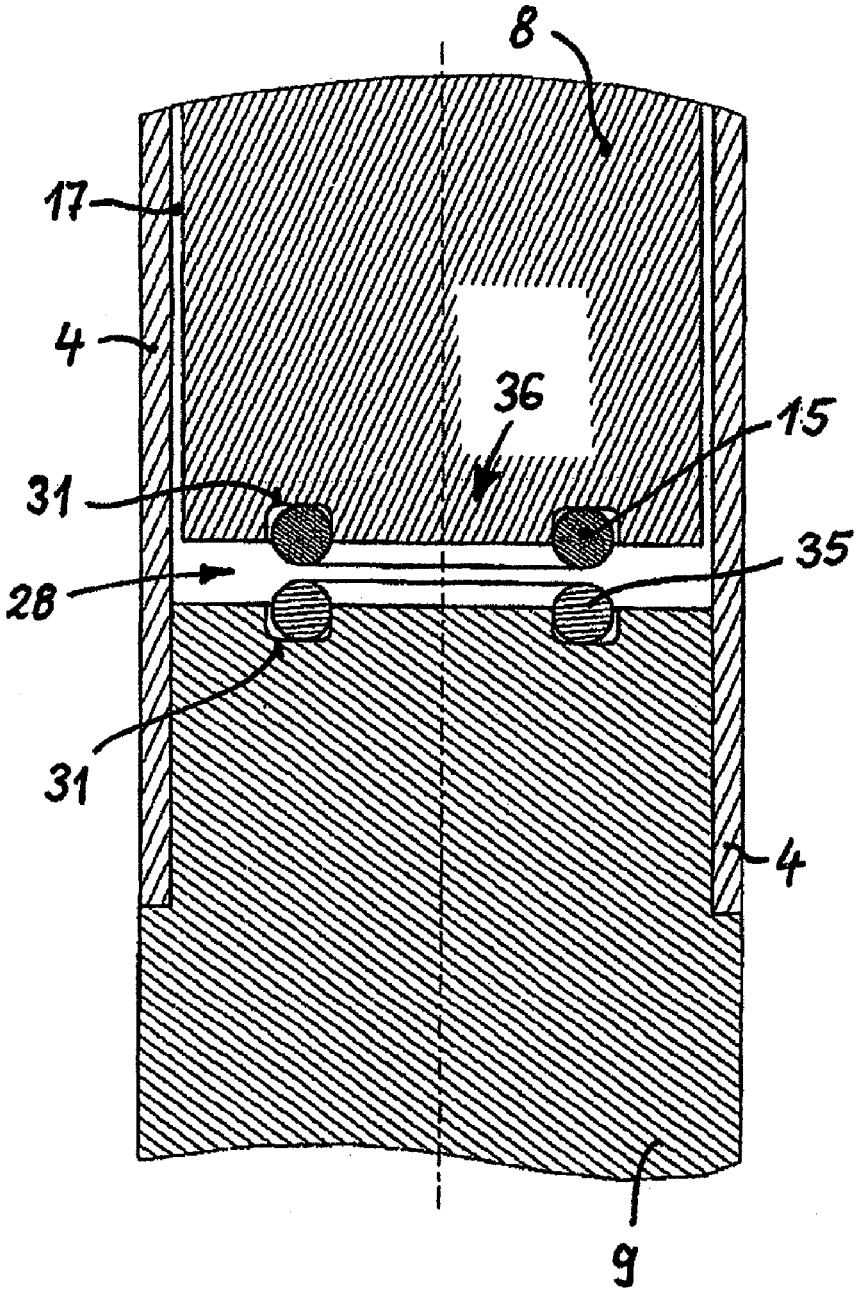

Another variant of the elastic damper 36 is shown in FIG. 4. Another elastic ring 35 in the stop element 9 is here allocated to the ring 15 in the armature 8 such that during operation, the compression volume is formed between the two rings. Due to the "rubber on rubber" contract, on the one side, the operating noise is further reduced and, on the other side, potential wear and tear by friction against the stiff limiting wall is eliminated.

Figure 5:
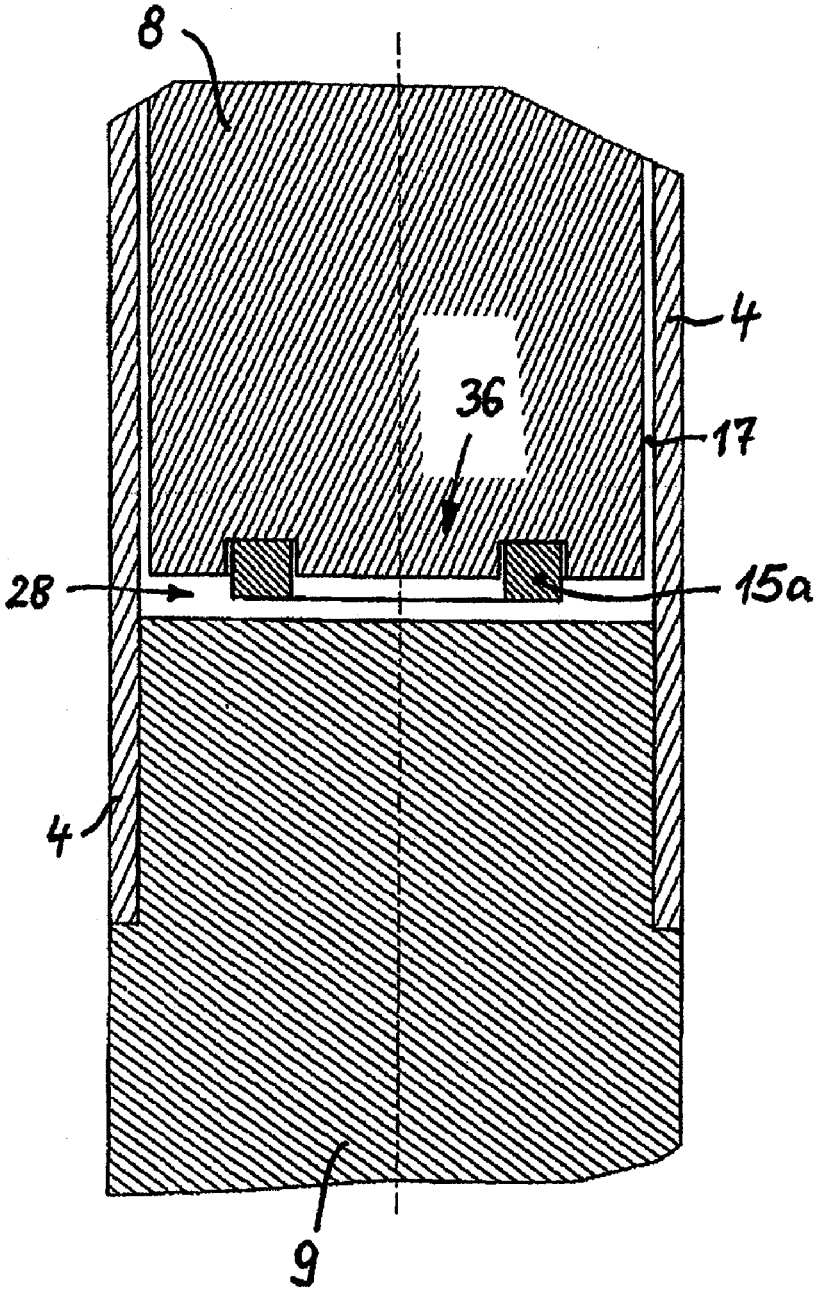

In the embodiment of an elastic damper 36 according to FIG. 5, the elastic ring 15*a* is embodied as a flat ring. For example, such flat rings can be punched or cut out of an elastic sheet material. The ring can be produced in arbitrary dimensions in a simple fashion, so that a fine adjustment of the dampening is possible. Due to the greater, flat contact area the dampening is also considerably harder and allows a great dampening effect even at short distances. In this way, the dampening can occur over a very short distance and accordingly the operating gap 28 can be kept narrow for high pump pressures.

Figure 6:
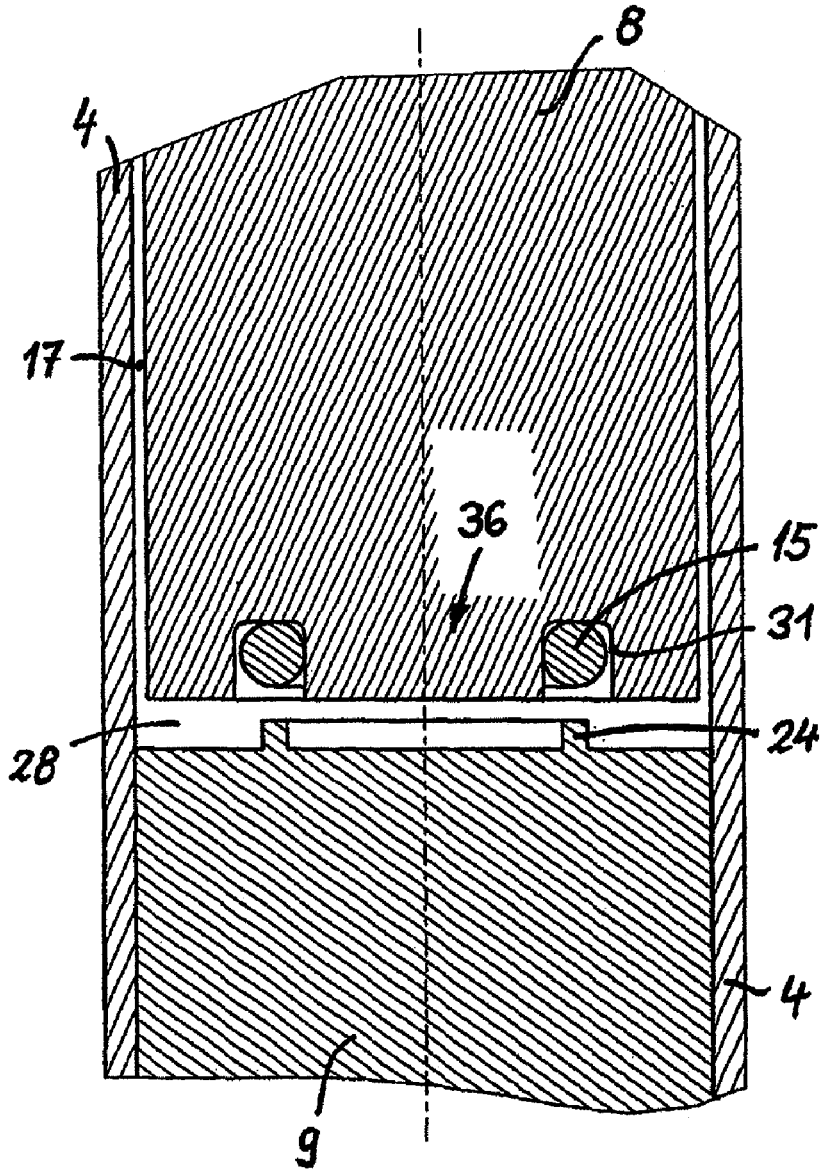

FIG. 6 shows another embodiment of the elastic damper 36, in which the facial limiting wall of the armature 8 projects beyond the elastic ring 15 located in the groove 31.

At the opposite limiting wall of the stop element 9, a circular flange 24 is provided, impinging the ring 15 in the contact position, which limits the compression chamber when contacting the ring 15. Due to the fact that the ring 15 is arranged entirely inserted in the groove 31, the ring 15 is held particularly securely.

Figure 7:
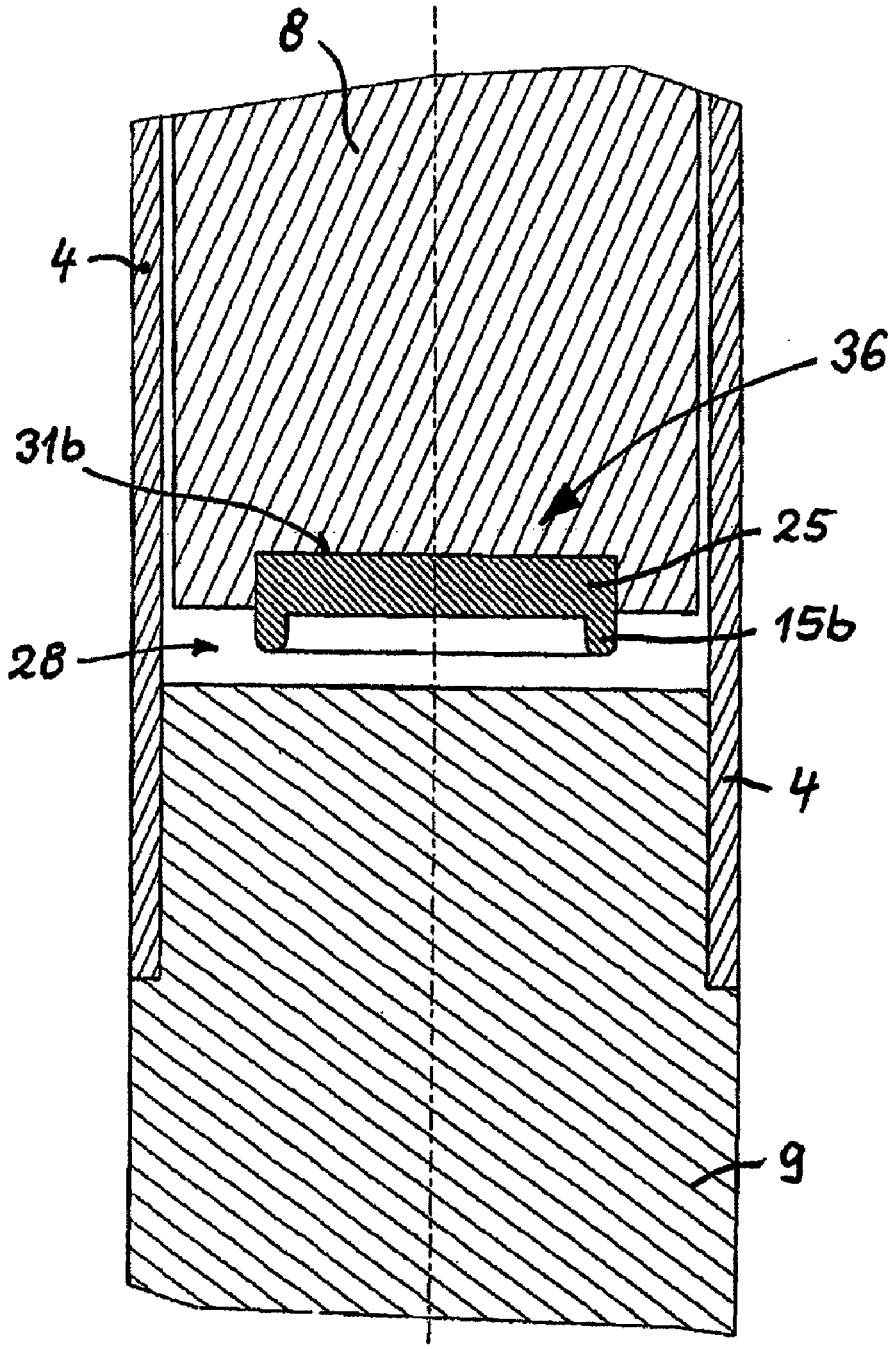

In the embodiment shown in FIG. 7, the elastic damper 36 is essentially formed by a cup-shaped formed part, comprising a plate 25 with a ring 15*b*, formed in one piece at the outside perimeter, and comprising an elastic material. The cup-shaped formed part is inserted into a recess 31*b* of the armature 8.

It is also possible to insert only the plate-shaped part 25 without any connected elastic ring 15*b* formed on it, however, in connection with a recess 16, for example shown in FIG. 2, or also into the plate 25 itself.

It should also be mentioned that several compression chambers 26 may be provided when appropriate space is available. For example, instead of a central ring 15, as shown in FIG. 1, several, for example three, rings 15 may be provided side-by-side at the bottom face of the armature 8 and accordingly form three compression chambers in connection with the face of the stop element 9.

The invention claimed is:

1. A solenoid diaphragm pump (1) comprising:

a diaphragm (11), located inside a pump housing, a diaphragm chamber created by the diaphragm and a diaphragm cover of the pump housing, a solenoid with a movable magnetic armature (8) that acts opposite to a force of a spring to actuate the diaphragm (11) between an upper dead center position and a bottom dead center position to pump a fluid via the diaphragm chamber; and a stop element (9) for adjusting a stroke length of the armature (8), the stop element having at least one elastic damper (36) provided between the armature (8) and the stop element (9), the elastic damper (36) comprises at least one compression chamber (26), enclosed and formed by at least one elastic limiting wall; and the at least one elastic limiting wall contacts at least one stiff limiting wall of at least one of the armature (8) or the stop element (9); and as the armature moves the diaphragm to the bottom dead center position the at least one compression chamber provides a progressive damping characteristic that is independent of the force of the spring.

2. The solenoid diaphragm pump according to claim 1, wherein the at least one elastic limiting wall is formed by an elastic ring (15).

3. The solenoid diaphragm pump according to claim 2, wherein the at least one stiff limiting wall of the armature (8) or the stop element (9) comprises a groove (31), into which the elastic ring (15) can be inserted or a shoulder (31*a*) onto which the elastic ring (15) can be placed.

4. The solenoid diaphragm pump according to claim 3, wherein the elastic ring (15) inserted into the groove (31) or placed upon the shoulder (31*a*) projects beyond the at least one stiff limiting wall.

5. The solenoid diaphragm pump according to claim 3, wherein the at least one stiff limiting wall ends flush with or projects from the elastic ring (15) inserted into the groove (31) or placed upon the shoulder (31*a*) and a circumferential circular flange (24) is arranged on an opposite stiff limiting wall impinging the ring (15) in a stop position.

6. The solenoid diaphragm pump according to claim 4, wherein the elastic ring (15*b*) is formed with an elastic plate (25) and forms a cup-shaped formed part in one piece with the plate (25).

7. The solenoid diaphragm pump according to claim 1, wherein the at least one stiff limiting wall of said at least one of the armature or the stop element comprises a recess (16) in an interior section of the at least one elastic limiting wall which is formed by an elastic ring.

8. The solenoid diaphragm pump according to claim 1, wherein a sheath (4) is provided, encompassing the armature (8), which comprises a ventilation opening (27) for ventilating an operating gap (28) located between the armature (8) and the stop element (9).

9. The solenoid diaphragm pump according to claim 1, wherein at least one diaphragm compression chamber (34) is provided in a region of a diaphragm chamber (37), and valve connection channels (39) opening in the diaphragm chamber (37) comprise sealing edges (23, 23*a*) extending into the diaphragm chamber (37.)

* * * * *